US006942529B2

(12) United States Patent
Fujimoto et al.

(10) Patent No.: US 6,942,529 B2
(45) Date of Patent: Sep. 13, 2005

(54) PRESS-CLAMPING TERMINAL

(75) Inventors: Kei Fujimoto, Shizuoka (JP); Masanori Onuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/733,571

(22) Filed: Dec. 12, 2003

(65) Prior Publication Data

US 2004/0157504 A1 Aug. 12, 2004

(30) Foreign Application Priority Data

Dec. 13, 2002 (JP) ..... P2002-362789

(51) Int. Cl.[7] ..... H01R 4/10
(52) U.S. Cl. ..... 439/886
(58) Field of Search ..... 439/442, 877, 439/886; 174/84 C

(56) References Cited

U.S. PATENT DOCUMENTS 2,815,497 A * 12/1957 Redslob ..... 439/203
3,895,851 A * 7/1975 Bolton et al. ..... 439/387
3,912,358 A * 10/1975 Miller et al. ..... 439/877
5,245,132 A * 9/1993 Luetzow ..... 174/74 R
5,849,424 A * 12/1998 Sugawara et al. ..... 428/674

FOREIGN PATENT DOCUMENTS

JP 8-321330 A 12/1996
JP 8-321331 A 12/1996

* cited by examiner

*Primary Examiner*—Phuong Dinh
(74) *Attorney, Agent, or Firm*—Sughrue Mion, PLLC

(57) ABSTRACT

A press-clamping terminal of the invention is press-fastened at its conductor-clamping portion on an outer periphery of a conductor part of a wire so as to be electrically connected to the conductor part. A plating layer is formed at least on an inner surface of the conductor-clamping portion for contact with the conductor part, the plating layer being harder than a passivation layer formed on a surface of the conductor part, and being excellent in electrical conductivity. With this construction, the hard plating layer fractures the passivation layer upon press-fastening of the conductor-clamping portion on the conductor part of the wire, thereby providing the good press-clamping condition in which any passivation layer, increasing the contact resistance, is not interposed between the press-clamping terminal and the conductor part.

2 Claims, 3 Drawing Sheets

PRESS-CLAMPING TERMINAL

The present application is based on Japanese Patent Application No. 2002-362789, the entire contents of which are incorporated herein by reference.

BACKGROUND OF THE INVENTION

1. Field of the Invention

This invention relates to a press-clamping terminal for being press-fastened at its conductor-clamping portion on an outer periphery of a conductor part of a wire so as to be electrically connected to the conductor part, and more particularly to an improvement in which an electrically-connected condition with a stable and small contact resistance can be maintained for a long period of time regardless of whether or not a passivation layer is formed on a surface of the conductor part of the wire.

2. Related Art

There are known various forms of connection of wires, and examples of such wire connection forms include a connection form using a press-clamping terminal, a connection form using a press-contacting terminal, a connection form in which a wire conductor is joined directly to a mating conductor by welding (spot welding or ultrasonic welding), and a connection form using soldering.

A press-clamping terminal is the type of connection terminal which is electrically connected to a conductor part of a wire by press-fastening a conductor-clamping portion thereof on an outer periphery of the conductor part. By changing the form of a distal end portion of such a terminal, various types, such as a screw-fastening type and a male-female fitting connection type, have been developed.

As compared with other wire connection forms, a wire connection form, using a press-clamping terminal, has advantages that the mechanical strength of connection to a wire can be easily secured and that an on-site operation can be carried out easily since only a compact press-fastening tool is required for connecting the press-clamping terminal to the wire. Therefore, this wire connection form still has a high utility value even at the present time.

By the way, electronic devices for being driven by a very small current/voltage have been extensively used in recent electric equipments, electronic equipments and so on, and therefore there is a possibility that a slight current fluctuation or a slight voltage fluctuation due to variations in contact resistance at a wire-connected portion causes a malfunction of a circuit.

Therefore, it has become important to maintain an electrically-connected condition with a stable and small contact resistance at the wire-connected portion over a long period of time.

Under this background, connection forms, shown respectively in FIGS. 4 and 5, have been proposed as a technique for reducing a contact resistance at the wire-connected portion.

In the connection form shown in FIG. 4, when a conductor-clamping portion 3 of a press-clamping terminal is to be press-fastened around a plurality of conductors (wire elements) 1, powder 4 of metal, softer than a material of which each conductor 1 is made, is beforehand coated onto an outer periphery of each of the conductors 1, and when the press-fastening operation is finished, interstices (or gaps) between the conductors 1 are filled with the metal powder 4, thereby increasing the electrical contact area so as to reduce the contact resistance and also to make the contact resistance stable for a long period of time (see, for example, JP-A-8-321330).

In the connection form shown in FIG. 5, when a conductor-clamping portion of a press-clamping terminal is to be press-fastened around a plurality of conductors (wire elements) 6, electrically-conductive powder 7, harder than a material of which each conductor 6 is made, is beforehand coated onto an outer periphery of each of the conductors 6, and when the press-fastening operation is finished, the electrically-conductive particles 7 pierce passivation layers (oxide layers) formed on the surfaces of the conductors 6, thereby preventing a contact resistance between the conductors 6, as well as a contact resistance between the conductors 6 and the conductor-clamping portion, from being increased by the intervening passivation layers 9 (see, for example, JP-A-8-321331).

Both of the countermeasures, proposed respectively in the above Patent Publications JP-A-8-321330 and JP-A-8-321331, have a problem that much time and labor are required for coating the metal powder 4 or the electrically-conductive powder 7 onto the wire conductors, so that the efficiency of the press-clamping connection operation is lowered.

And besides, both of the countermeasures, proposed respectively in the above Patent Publications JP-A-8-321330 and JP-A-8-321331, have another problem that it is not easy to coat the metal powder 4 or the electrically-conductive powder 7 uniformly onto the surfaces of the plurality of conductors, and the effect is liable to be varied by the uneven coating.

Furthermore, when a wire whose conductors are made of an aluminum base material or an iron-nickel alloy is exposed to the air, a passivation layer (oxide layer) is liable to be formed on the surfaces of the conductors. This passivation layer is harder than the conductor material, and is lower in electrical conductivity than the conductor material.

In the case of the above JP-A-8-321330, there has been encountered a problem that the metal powder 4 can not pierce the passivation layer, so that the increase of the contact resistance due to the intervening passivation layers can not be overcome.

On the other hand, in the case of the above JP-A-8-321331, it is quite possible that the electrically-conductive powder 7 pierces the passivation layers 9 if the electrically-conductive powder 7 is harder than the passivation layers 9. However, when the electrically-conductive powder 7, coated on the conductors 6, still has fluidity, the coated electrically-conductive powder 7 is caused to escape or flow into the interstices between the conductors 6 by a pressing force applied during the press-fastening operation, and only a very small part of the electrically-conductive powder 7 effectively serves to pierce the passivation layers 9, and this has resulted in a problem that it is difficult to obtain a good contact condition over a wide area of the inner surface of the conductor-clamping portion of the press-clamping terminal.

SUMMARY OF THE INVENTION

This invention has been made in view of the above problems, and an object of the invention is to provide a press-clamping terminal in which even when passivation layers are formed on surfaces of conductors of a wire, those passivation layers, contacting an inner surface of a conductor-clamping portion of the press-clamping terminal, are fractured to thereby provide a good contact condition (in which any intervening passivation layer, increasing the contact resistance, does not exist) over a wide area of the inner surface of the conductor-clamping portion, so that the electrically-connected condition with the stable and small contact resistance can be stably maintained over a long period of time, and besides the efficiency of the press-clamping connection operation will not be lowered.

According to the invention, there is provided a press-clamping terminal for being press-fastened at its conductor-clamping portion on an outer periphery of a conductor part of a wire so as to be electrically connected to the conductor part; characterized in that a plating layer is formed at least on an inner surface of the conductor-clamping portion for contact with the conductor part, the plating layer being harder than a passivation layer formed on a surface of the conductor part, and being excellent in electrical conductivity.

In the press-clamping terminal of the above construction, even when the passivation layer is formed on the surface of the conductor part of the wire for press-clamping connection to the terminal, the plating layer, harder than the passivation layer, compresses (shears) and fractures the passivation layer upon press-fastening of the conductor-clamping portion, so that the conductor-clamping portion is brought into direct contact with the real surface of the conductor part through the plating layer of excellent electrical conductivity.

Therefore, by forming the plating layer on the inner surface of the conductor-clamping portion, for example, over an entire area thereof, there is provided a good contact condition (in which any intervening passivation layer, increasing a contact resistance, does not exist) over the wide area of the inner surface of the conductor-clamping portion, so that the electrically-connected condition with the stable and small contact resistance can be stably maintained over a long period of time.

And besides, by adding a plating step to the process of producing the press-clamping terminals, the formation of the plating layer can be collectively effected for a large number of press-clamping terminals, and as compared with the conventional method in which the hard electrically-conductive powder is coated on the surfaces of the plurality of conductors of the wire, the time and labor, required for the press-clamping connection, are much reduced, so that the efficiency of the press-clamping connection operation can be enhanced.

The press-clamping terminal of the invention is further characterized in that the plating layer is a hard nickel-plating layer having Vickers hardness (Hv) of not smaller than 500.

The type of wire in which a passivation layer is liable to be formed has a conductor made of an aluminum base material or an iron-nickel alloy, and an ordinary press-clamping terminal is made, for example, of aluminum or an aluminum alloy.

The hard nickel-plating layer is equivalent to or more excellent than the conductor of such a wire and such a press-clamping terminal in electrical conductive characteristics, and exhibits good adhesion to the material of the press-clamping terminal in the plating process.

Namely, with the above construction, even though the plating layer is interposed between the wire conductor and the press-clamping terminal, this plating layer will not increase the contact resistance.

And besides, by providing the hard nickel-plating layer having Vickers hardness (Hv) of not smaller than 500, this plating layer can easily fracture the passivation layer which usually has low Vickers hardness (Vs).

The press-clamping terminal of the invention is further characterized in that the plating layer is a nickel composite plating layer in which material molecular crystals, harder than the passivation layer formed on the surface of the conductor part, are dispersed in an eutectoid condition.

In the press-clamping terminal of the above construction, a pressing force, applied during the press-fastening operation, does not act uniformly on the entire area of the contact surface, but concentrates on the microscopic positions of the dispersed hard carbide crystals, and therefore the pressing force, applied during the press-fastening operation, efficiently acts as a shearing load on the passivation layer, so that the passivation layer is easily fractured.

Examples of the above material molecular crystal, harder than the passivation layer, include an oxide such as silicon dioxide, and a carbide such as silicon carbide.

The press-clamping terminal of the invention is further characterized in that the plating layer is formed into a dull finish.

In the press-clamping terminal of the above construction, a large number of fine pits and projections exit on the surface of the dull-finished plating layer, and therefore when the conductor-clamping portion is press-fastened, these pits and projections transmit this pressing force as a number of shearing forces to the passivation layer disposed in contact with the plating layer.

Therefore, the shear fracture of the passivation layer by the plating layer is effected more easily and positively.

DETAILED DESCRIPTION OF THE PREFERRED EMBODIMENTS

Figure 1:
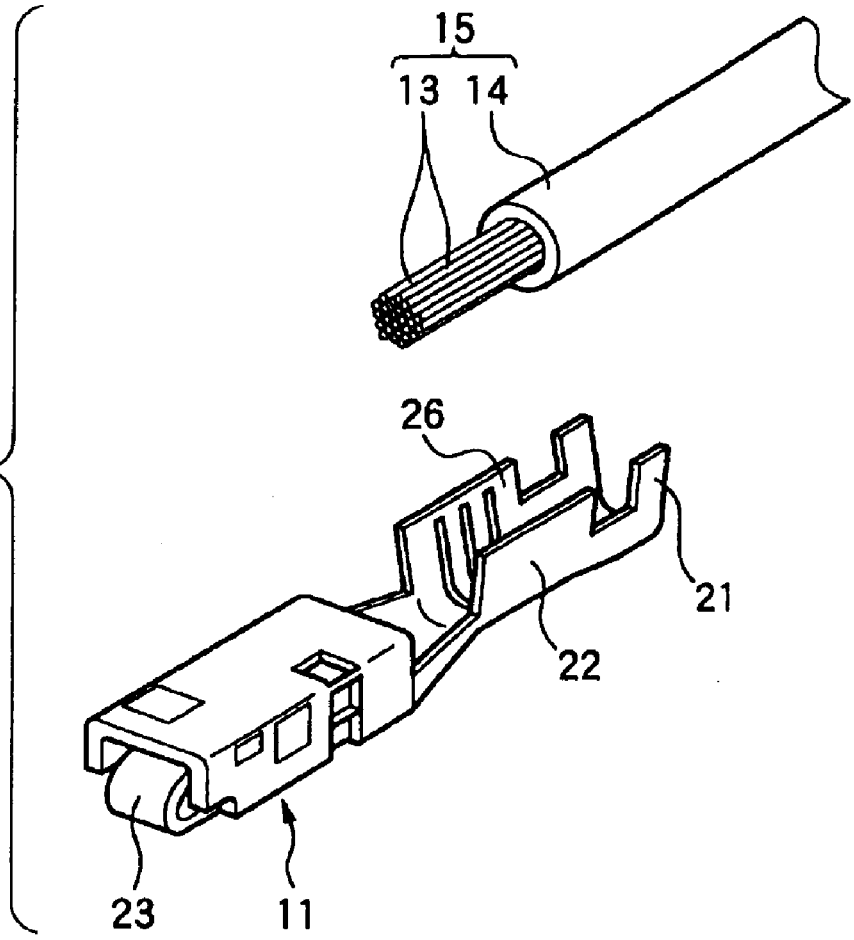
FIG. 1 is a perspective view of one preferred embodiment of a press-clamping terminal of the present invention.

One preferred embodiment of a press-clamping terminal of the present invention will now be described in detail with reference to the accompanying drawings. FIG. 1 is a perspective view of one preferred embodiment of the press-clamping terminal of the invention.

As shown in FIG. 1, the press-clamping terminal 11 of this embodiment is adapted to be press-clamped and connected to an end portion of a sheathed wire (cable) 15 having a plurality of conductors (wire elements) 13 covered with an insulating sheath 14.

In this sheathed wire 15, the conductors are made, for example, of an aluminum base material or an iron-nickel alloy.

The press-clamping terminal 11 of this embodiment is a pressed product made of aluminum or an aluminum alloy, and this terminal 11 includes a sheath-clamping portion 21, a conductor-clamping portion 22, and a fitting connection portion 23 which are arranged in this order from a proximal end thereof.

Figure 3:
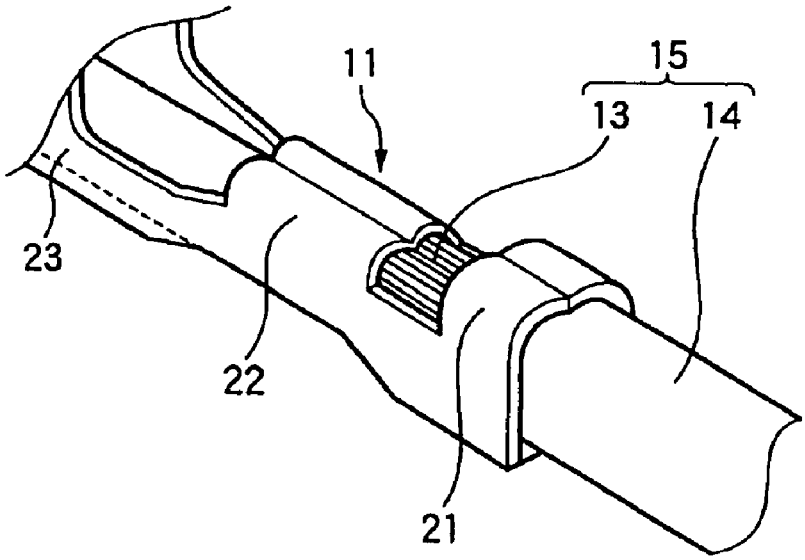
FIG. 3 is a perspective view showing a condition in which the press-clamping connection of the press-clamping terminal of FIG. 1 is completed.
Figure 4:
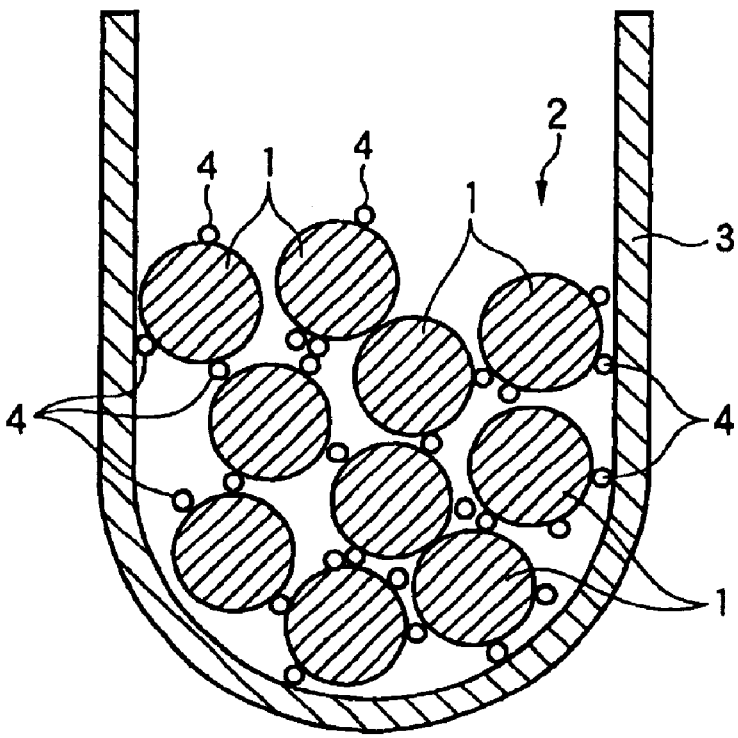
FIG. 4 is a view explanatory of a press-clamping method in which a contact resistance is reduced in a conventional press-clamping terminal.
Figure 5:
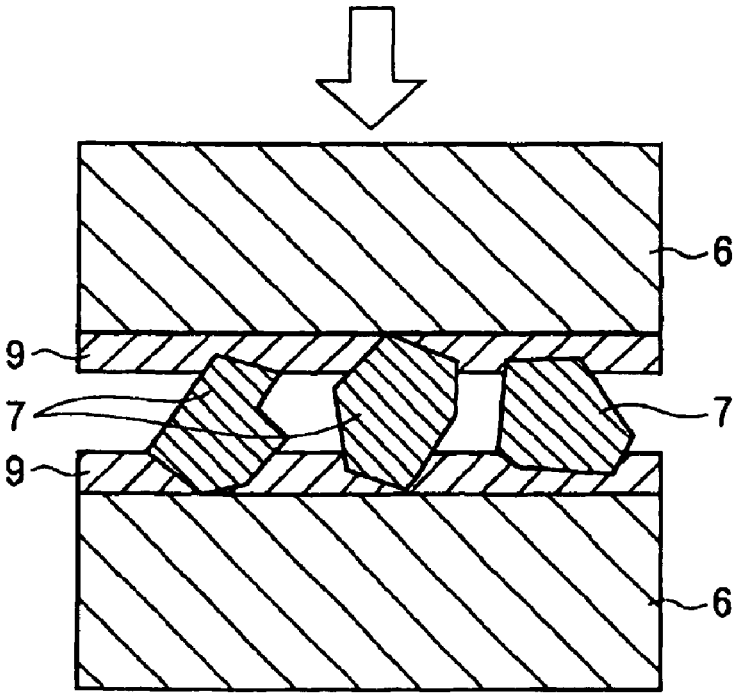
FIG. 5 is a view explanatory of another press-clamping method in which a contact resistance is reduced in a conventional press-clamping terminal.

As shown in FIG. 3, the sheath-clamping portion 21 is press-fastened on the insulating sheath 14 of the sheathed wire 15, and therefore is fixed to the end portion of the wire.

As shown in FIG. 3, the conductor-clamping portion 23 is press-fastened around that portion of the conductor part (composed of the plurality of conductors 13) exposed by removing the insulating sheath 14, and therefore is electrically connected to the conductors 13 in a press-clamped manner.

The fitting connection portion 23 is electrically connected to a terminal connection portion of a mating terminal (not shown) by male-female fitting connection.

Figure 2:
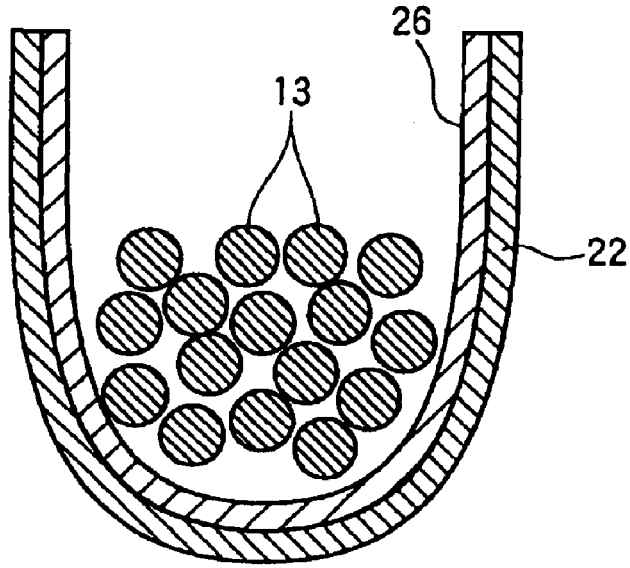
FIG. 2 is a transverse cross-sectional view the press-clamping terminal of the above embodiment shown in FIG. 1.

In this embodiment, a plating layer 26 is formed on an inner surface of the conductor-clamping portion 22 (for contact with the conductors 13) over an entire area thereof as shown in FIG. 2. This plating layer 26 is harder than passivation layers (oxide layers) formed on the surfaces of the conductors 13, and is excellent in electrical conductivity.

In this embodiment, the plating layer 26 is a hard nickel-plating layer having Vickers hardness (Hv) of not smaller than 500. For forming the hard nickel-plating layer, first, an electroless nickel-plating (Ni—P base plating) treatment is effected, and then the plated surface is heat-treated at a temperature of about 200° C. to about 300° C., thereby forming the plating layer 26.

In this embodiment, the plating layer (hard nickel-plating layer) 26 is formed into a dull finish having a large number of fine pits and projections formed on its surface.

When the wire 15 whose conductors are made of the aluminum base material or the iron-nickel alloy is exposed to the air, a passivation layer (oxide layer) is liable to be formed on the surfaces of the conductors. This passivation layer is harder than the conductor material, and is lower in electrical conductivity than the conductor material, and the passivation layers on the conductors usually increase a contact resistance during the press-clamping connection operation, and these passivation layers are a major cause for lowered electrical conductivity characteristics.

In the above press-clamping terminal 11, however, even when passivation layers are formed on the surfaces of the conductors 13 of the wire 15 for press-clamping connection to the terminal 11, the plating layer 26, harder than these passivation layers, compresses (shears) and fractures the passivation layers upon press-fastening of the conductor-clamping portion 22, so that the conductor-clamping portion 22 is brought into direct contact with the real surfaces of the relevant conductors 13 through the plating layer 26 of excellent electrical conductivity.

Therefore, by forming the plating layer 26 on the inner surface of the conductor-clamping portion 22 over the entire area thereof as described above for this embodiment, there is provided the good contact condition (in which any intervening passivation layer, increasing the contact resistance, does not exist) over the wide area of the inner surface of the conductor-clamping portion, so that the electrically-connected condition with the stable and small contact resistance can be stably maintained over a long period of time.

And besides, by adding a plating step to the process of producing the press-clamping terminals 11, the formation of the plating layer 26 can be collectively effected for a large number of press-clamping terminals 11, and as compared with the conventional method in which the hard electrically-conductive powder is coated on the surfaces of the plurality of conductors 13 of the wire 15, the time and labor, required for the press-clamping connection, are much reduced, so that the efficiency of the press-clamping connection operation can be enhanced.

The hard nickel-plating layer, used as the plating layer 26, exhibits good electrical conductivity characteristics for the conductors 13 of the wire 15, and also exhibits good adhesion to the bare surface of the conductor-clamping portion 22.

Therefore, even though the plating layer 26 is interposed between the conductors 13 of the wire 15 and the press-clamping terminal 11, this plating layer 26 itself will not increase the contact resistance.

By providing the hard nickel-plating layer 26 having Vickers hardness (Hv) of not smaller than 500 as described above, this layer 26 can easily fracture the passivation layers (which usually have low Vickers hardness (Vs)) on the conductors 13.

A large number of fine pits and projections exit on the surface of the dull-finished plating layer 26, and therefore when the conductor-clamping portion 22 is press-fastened, these pits and projections transmit this pressing force as a number of shearing forces to the passivation layers disposed in contact with the plating layer 26.

Therefore, the shear fracture of the passivation layers by the plating layer 26 is effected more easily and positively.

The plating layer 26 may be formed into a glossy finish if the plating layer 26 can sufficiently fracture the passivation layers.

The material of which the plating layer 26 is composed is not limited to the above hard nickel plating in so far as it meets the requirements with respect to the hardness, electrical conductivity, corrosion resistance, etc. For example, there may be used a nickel composite plating layer in which material molecular crystals, harder than the passivation layers formed on the surfaces of the conductors 13, are dispersed in an eutectoid condition.

Examples of the above material molecular crystal, harder than the passivation layers, include an oxide such as silicon dioxide, and a carbide such as silicon carbide.

In the case where such nickel composition plating layer is used, the pressing force, applied during the press-fastening operation, does not act uniformly on the entire area of the contact surface, but concentrates on the microscopic positions of the dispersed hard material molecular crystals, and therefore the pressing force, applied during the press-fastening operation, efficiently acts as a shearing load on the passivation layers, so that these passivation layers are easily fractured.

Although the thickness of the plating layer 26, formed on the inner surface of the conductor-clamping portion 22, may be uniform over the entire area thereof, the thickness of the plating layer 26 may also be uneven in order to enhance the shearing performance.

The region where the plating layer 26 is formed is not limited only to the inner surface of the conductor-clamping portion 22. In so far as the plating layer 26 is formed at least on the inner surface of the conductor-clamping portion 22, the plating layer 26 may be formed also on other portions (such for example as the inner surface of the sheath-clamping portion 21 and the outer surface of the conductor-clamping portion 22), in which case any difficulty is not encountered in the press-clamping connection. Preferably, the plating area is determined, taking into consideration the time, labor and cost required, for example, for the masking used in the plating process.

In the above embodiment, the main component of the plating layer 26, formed at least on the inner surface of the conductor-clamping portion 22, is nickel.

However, the main component of the plating layer 26 is not limited to that described in the above embodiment. Any other suitable metal material, at least equivalent in various physical properties (such as electrical conductivity, Vickers hardness (Hv) and corrosion resistance) to nickel, can be used as a main component.

As described above, in the press-clamping terminal of the invention, the plating layer fractures the passivation layer upon press-fastening of the conductor-clamping portion on the wire conductor, so that the conductor-clamping portion is brought into direct contact with the real surface of the conductor through the plating layer of excellent electrical conductivity.

Therefore, there is provided the good condition of contact between the press-clamping terminal and the wire conductor (in which any intervening passivation layer, increasing the contact resistance, does not exist), so that the electrically-connected condition with the stable and small contact resistance can be stably maintained over a long period of time.

And besides, by adding the plating step to the process of producing the press-clamping terminals, the formation of the plating layer can be collectively effected for a large number of press-clamping terminals, and as compared with the conventional method in which the hard electrically-conductive powder is coated on the surfaces of the plurality of conductors of the wire, the time and labor, required for the press-clamping connection, are much reduced, so that the efficiency of the press-clamping connection operation can be enhanced.

In the press-clamping terminal of the invention, the type of wire in which a passivation layer is liable to be formed has a conductor made of an aluminum base material or an iron-nickel alloy, and an ordinary press-clamping terminal is made, for example, of aluminum or an aluminum alloy. The plating layer, formed on the conductor-clamping portion, exhibits good electrical conductivity characteristics for such wire. Also the adhesion of the plating layer to the press-clamping terminal is good. Therefore, even though the plating layer is interposed between the wire conductor and the press-clamping terminal, this plating layer will not increase the contact resistance.

And besides, by providing the hard nickel-plating layer having Vickers hardness (Hv) of not smaller than 500, this plating layer can easily fracture the passivation layer on the wire.

In the press-clamping terminal of the invention, a pressing force, applied during the press-fastening operation, does not act uniformly on the entire area of the contact surface, but concentrates on the microscopic positions of the dispersed hard carbide crystals, and therefore the pressing force, applied during the press-fastening operation, efficiently acts as a shearing load on the passivation layer, so that the passivation layer is easily fractured.

In the press-clamping terminal of the invention, a large number of fine pits and projections exit on the surface of the dull-finished plating layer, and therefore when the conductor-clamping portion is press-fastened, these pits and projections transmit this pressing force as a number of shearing forces to the passivation layer disposed in contact with the plating layer.

Therefore, the shear fracture of the passivation layer by the plating layer is effected more easily and positively.

What is claimed is:

1. A press-clamping terminal comprising:

a conductor-clamping portion for press-fastening an outer periphery of a conductor part of a wire for electric connection;

wherein a plating layer being excellent in electrical conductivity is formed at least on an inner surface of said conductor-clamping portion, and said plating layer is harder than a passivation layer formed on a surface of said conductor part;

wherein said plating layer is a nickel composite plating layer in which material molecular crystals, harder than said passivation layer formed on the surface of said conductor part, are dispersed in an eutectoid condition; and wherein said plating layer is formed into a dull finish.

2. A press-clamping terminal according to claim 1, wherein said plating layer has a Vickers hardness (Hv) of not smaller than 500.

* * * * *